US006177909B1

(12) United States Patent
Reid et al.

(10) Patent No.: US 6,177,909 B1
(45) Date of Patent: Jan. 23, 2001

(54) SPATIALLY LIGHT MODULATED RECONFIGURABLE PHOTOCONDUCTIVE ANTENNA

(75) Inventors: James R. Reid, Cambridge; John S. Derov, Lowell; Paul H. Carr, Bedford, all of MA (US)

(73) Assignee: The United States of America as represented by the Secretary of the Air Force, Washington, DC (US)

( * ) Notice: Under 35 U.S.C. 154(b), the term of this patent shall be extended for 0 days.

(21) Appl. No.: 09/433,762

(22) Filed: Nov. 4, 1999

(51) Int. Cl.[7] ..... H01Q 1/38

(52) U.S. Cl. ..... 343/700 MS; 343/795; 343/792.5

(58) Field of Search ..... 343/700 MS, 793, 343/795, 810, 792.5; H01Q 1/38

(56) References Cited

U.S. PATENT DOCUMENTS 5,986,796 11/1999 Miles ..... 359/260

OTHER PUBLICATIONS

Larry J. Hornbeck. "Digital Light Processing™ for High–Brightness High–Resolution Applications", see attached. Feb. 10–12, 1997.

D.W. Liu, P.H. Carr et al "Nonlinear Photoconductivity Characteristics of Antenna Activated by 80–Picosecond Optical Pulses". see attached. Jun., 1996.

D. Liu, M. Bergeron at al. "Structurally Embedded Photoconductive Silicon Bowtie Antenna" see attached. May 1998.

D.W. Liu, E.E. Crisman et al. "Two and Three Dimensional, Re–configurable Arrays using optical generation as the source–antenna elements". See attached. Jan. 14, 15, 16, 1997.

X. –C. Zhang and D. H. Auston. "Opticoelectronic measurement of Semiconductor surfaces and interfaces with femtosecond optics." J. Appl. Phys. 71 (1) Jan. 1992.

*Primary Examiner*—Hoanganh Le
(74) *Attorney, Agent, or Firm*—William G. Auton; Stanton E. Collier

(57) ABSTRACT

A reconfigurable photoconducting antenna is created on a semiconductor substrate. At equilibrium, the semiconductor is semi-insulating, and therefore appears as a dielectric. Illuminating a region of the substrate results in the generation of free carriers in the substrate and allows the creation of a conductive region (semi-metallic) in the substrate. This conductive region functions as the radiating element of the antenna. Controlling the pattern of the illuminated region directly controls the pattern of the radiating antenna. By using a digital micromirror device (DMD™) to control the pattern of the light, a desired antenna design may be placed on the semiconductor substrate. The pattern can be dynamically adjusted simply by changing the position of the individual mirrors in the DMD™ array. The device operates through a standardized digital interface and can be switched between patterns in a period of approximately 20 microseconds. The pattern of the DMD™ can therefore be readily and easily controlled through the use of a digital control system.

16 Claims, 2 Drawing Sheets

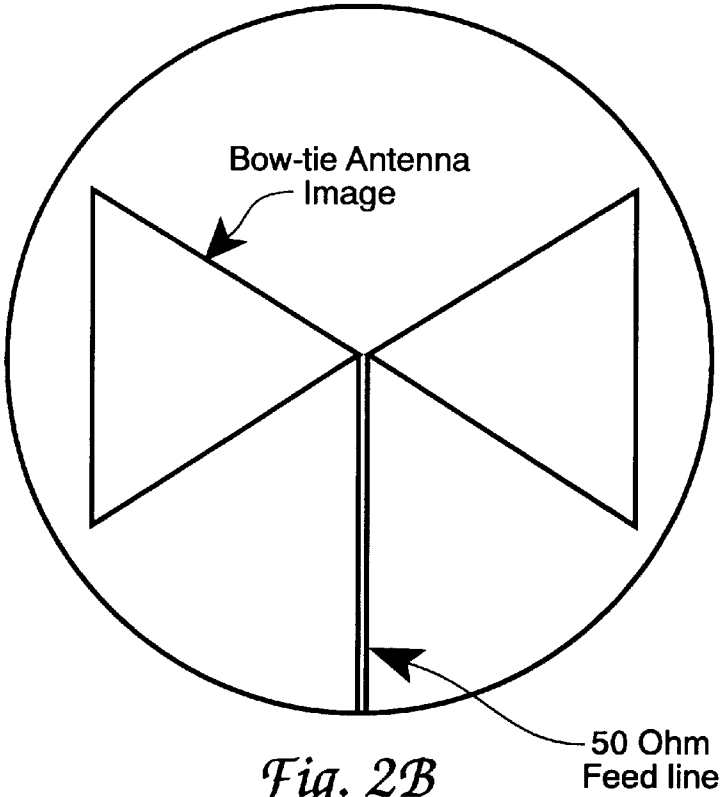
Fig. 2B
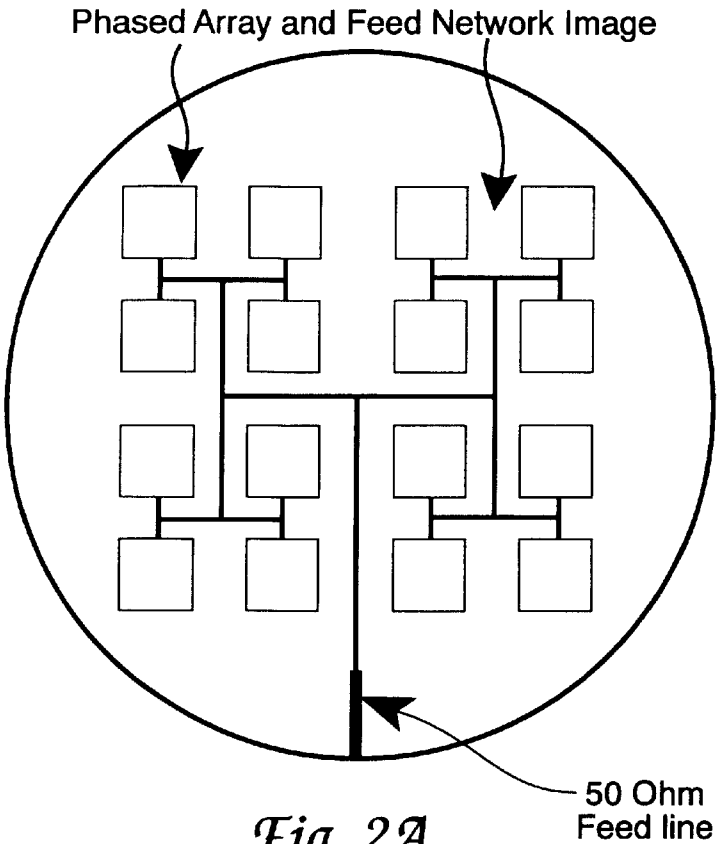
Fig. 2A
Fig. 2

SPATIALLY LIGHT MODULATED RECONFIGURABLE PHOTOCONDUCTIVE ANTENNA

STATEMENT REGARDING FEDERALLY SPONSORED RESEARCH OR DEVELOPMENT

The invention described herein may be manufactured and used by or for the Government for governmental purposes without the payment of any royalty thereon.

CROSS-REFERENCES TO RELATED PATENT APPLICATIONS

None.

BACKGROUND OF THE INVENTION

The present invention relates to antennae, and, in particular, to devices for actively changing the antenna structure.

In the past, microwave antennae have been constructed having a fixed frequency response therein. This fixed response can not be changed to accommodate different operating frequencies. However, many systems, such as aircraft, require antennae operating over multiple frequency bands. Thus, there exists a need for a means of changing an antenna's structure upon command to control the operating frequency of the antenna.

At equilibrium, a semiconductor is semi-insulating, and therefore appears as a dielectric. Illuminating a region of a semiconductor substrate with light of a preselected wavelength results in the generation of free carriers in the substrate and allows the creation of a conductive region (semi-metallic) in the substrate. The generated conductive region can function as an antenna operating over a specific frequency range and with a set radiation pattern. Thus by controlling the pattern of light projected onto the semiconductor substrate, the frequency and radiation pattern of the antennae can be changed.

BRIEF SUMMARY OF THE INVENTION

A reconfigurable photoconductive antenna is created by projecting an image onto a semiconductor substrate. The image is controlled via a digital micromirror device array which is illuminated by a laser source. Based on the photoconductive nature of semiconductors, the areas illuminated by the laser become metallic in nature and form either a single antenna or a phased array antenna comprised of multiple radiating elements. The antenna is reconfigured by electronically driving the digital micromirror device (DMD™) array, which serves as a spatial light modulator. Changing the pattern of the DMD™ array changes the pattern of the reflected light, and thus results in a modification of the antenna pattern. This technique allows the radiating antenna to be modified such that many planar antenna patterns are possible. Example patterns include patch radiators, bow tie antennas, and phased array antennas comprised of multiple radiating elements. The generated antenna pattern is useful in communication and radar systems. Advantages of this new invention include low radar cross section and ultra-wide bandwidth operation.

One object of the present invention is to provide a reconfigurable antenna capable of operating over multiple frequencies. Thus allowing a single antenna to provide the functionality of multiple antennas.

Another object of the present invention is to provide a reconfigurable antenna that optimizes the antenna radiation pattern to a given application.

Another object of the present invention is to provide an antenna capable of being easily and electronically switched between a variety of antenna types including: a log periodic antenna, a bow-tie antenna, or a phased array antenna with multiple radiating elements.

These and many other objects and advantages of the present invention will be apparent to one skilled in the pertinent art from the following detailed description of a preferred embodiment of the invention and the related drawings.

BRIEF DESCRIPTION OF THE SEVERAL VIEWS OF THE DRAWINGS

20, FIG. 1 shows a 3×3 array of the digital micromirror assembly.

FIGS. 2A and 2B show the projected images of a phased array and bow-tie antenna on the GaAs substrate.

DETAILED DESCRIPTION OF THE INVENTION

Figure 1:
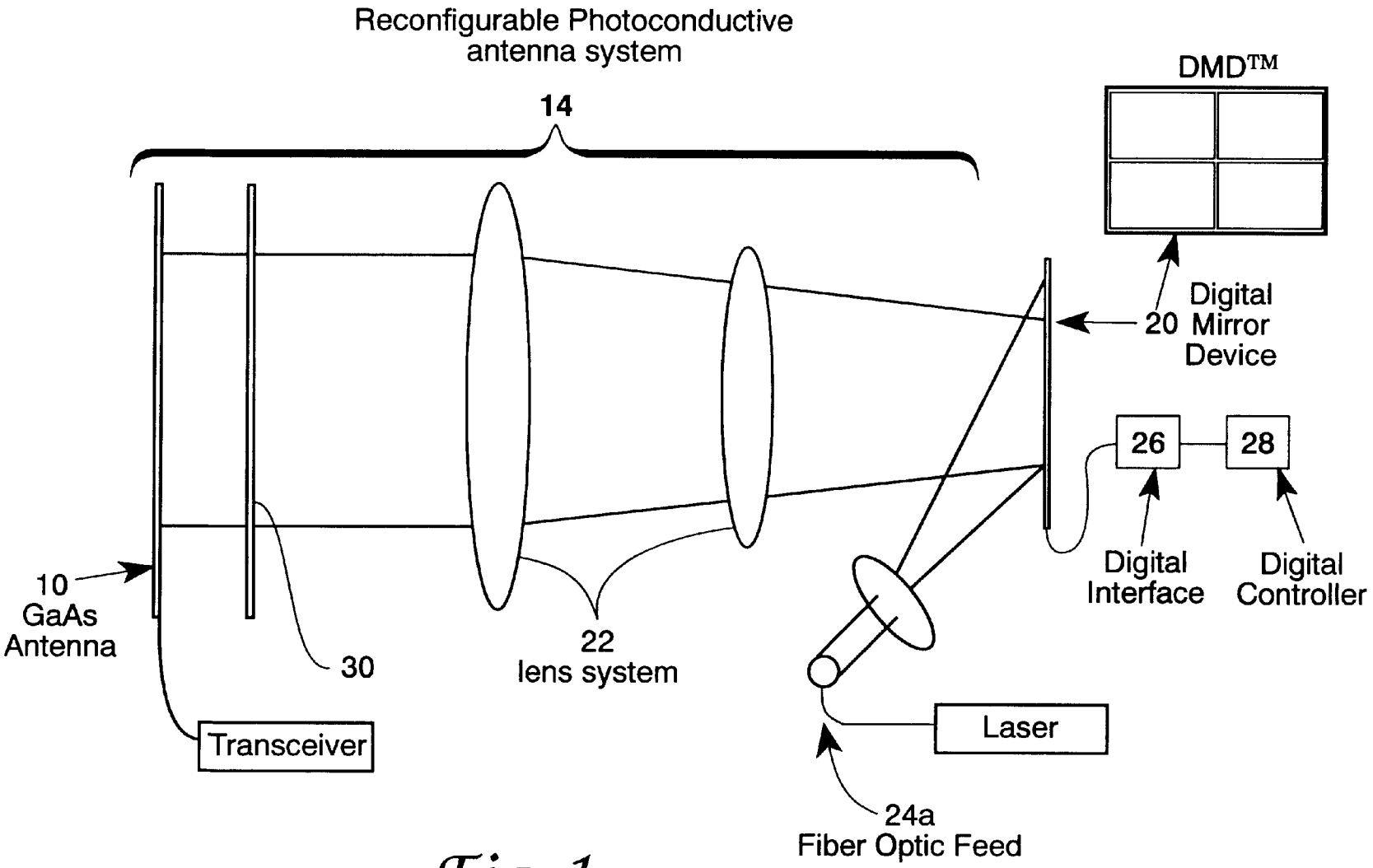
FIG. 1 illustrates by schematic diagram of a spatially light modulator reconfigurable photoconductive antenna.

Modern aircraft require a variety of antenna systems. This is often driven by the need for communication and radar systems that operate at a variety of frequencies. As an example, military aircraft commonly include Milstar receivers at 20 GHz, Milstar transmitters at 44 GHz; GPS receivers, that operates between 1 to 2 GHz, and communication radios that may operate between 0.5 to 2 GHz. The result is an increasing number of antenna systems and a corresponding increase in the mass and volume that these systems require. Further, a metal antenna inherently increases the radar cross section of an aircraft.

A reconfigurable photoconductive antenna 10, FIG. 1, will be capable of functioning at multiple frequencies, thereby reducing the number of antennas required. Further, the when not in use, the antenna 10 is a dielectric and therefore does not serve as a significant source of radio frequency reflections. As a result, a reconfigurable photoconducting antenna 10 will reduce the total platform radar cross section by both reducing the number of antennas and eliminating the metal elements in the antennas.

The design of the reconfigurable photoconductive antenna 10 is controlled through the use of a laser projected image controlled by a spatial light modulator 20. By utilizing the spatial light modulator 20, the antenna can be easily and electronically switched between a variety of antenna types including: a log periodic antenna, a bow-tie antenna, FIG. 2B, or a phased array antenna with multiple radiating elements, FIG. 2A.

The reconfigurable photoconductive antenna system 14 consist of a semiconductor substrate 10 with a 50 ohm feed line 16, FIG. 2A, on it, a high intensity monochromatic light source, typically a laser 18, digital micromirror device array 20, FIG. 1, and a lens system 22. A schematic diagram of the system 14 is shown in FIG. 1.

The first step in the fabrication of the antenna 10 is to chose the type or types of antennas to be configured, the frequency of operation, the type semiconductor and laser to be used for the antenna. For the purpose of this explanation, we will use gallium arsenide (GaAs) as the semiconductor, a phased array patch antenna and a bowtie antenna, and a diode pumped frequency doubled YAG laser. An ohmic feed line must be designed and fabricated on the GaAs surface. The impedance of this feed line is chosen to match the impedance of the transmitter or receiver. The design of the feed line is done by using standard transmission line models to determine the dimensions of a 50 ohm feed line. The feed line to provide the connection between the radar and/or communication transmitter or receiver.

The frequency of operation determines the wavelength of the antenna. From the wavelength the dimension of the antenna can be determined. The patches in FIG. 2A are half wavelength on each side of the individual patches with a separation of a half wavelength between the individual patches. The operating wavelength determines the length and the width of the bow-tie antenna. The antenna design can then be entered into a standard computer drawing package. The feed network is also part of the imaging process and connects the patch array to 50 ohm feed line for the transmitter or receiver. Basically this reconfigurable antenna can become any type of planar antenna that can be imaged on the surface of the semiconductor.

The antenna is controlled through the use of a laser projected image controlled by a spatial light modulator. By utilizing the spatial light modulator, the antenna can be easily and electronically switched between the different antenna types (the bow-tie antenna or a phased array antenna with multiple radiating elements). Here, a digital micromirror device (DMD™) 20, only partially shown, is used to control the pattern of the light to be projected on to the antenna substrate through the lens system 22. Use of the DMD™ 20 allows the pattern to by dynamically adjusted simply by changing the position of the individual mirrors in the device. The DMD™ is an array, of 16 micrometer$^2$ mirrors with 1 micrometer separation between each mirror. Each mirror consists of three physical layers and two air gap layers. The air gap layers separates the three physical layers and allow the mirror to till +/−10 degrees. It is the tilting action of the mirrors that modulates the light source to form the image. Laser light is brought in via fiber optical cable 24*a* to a beam expander 24*b* to illuminate the DMD™. The device operates through a standardized digital interface 26, not shown in detail, and can be switched between patterns in a period of approximately 20 microseconds. The pattern of the DMD™ can therefore be readily and easily controlled through the use of a digital control system 28. The reflected image from 20 the DMD™ is projected through a lens system 22 and focused on the GaAs surface 10 forming the antenna. The GaAs wafer, reflector, image transfer optics, DMD™ and laser comprise the reconfigurable photoconductive antenna as shown in FIG. 1.

To control the directivity of the antenna a plane to reflect the microwave energy can be placed on one side of the antenna. This part of the antenna is shown in FIG. 1 as a reflector 30 which can either be a metallic Fabry-Perot plate or a photonic band gap crystal.

Applications of this antenna system include ultra-wide bandwidth identification friend and foe radar system, high resolution radar, or secure microwave communication antenna.

Clearly many modifications and variations of the present invention are possible in light of the above teachings and it is therefore understood, that within the inventive scope of the inventive concept, that the invention may be practiced otherwise than specifically claimed.

What is claimed is:

1. A reconfigurable antenna system, said reconfigurable antenna system comprising:

means for inputting collimated light;

a spatial light modulator, said spatial light modulator receiving light from said means for inputting;

an electronic digital interface, said interface connected to said spatial light modulator; and a electronic digital control system, said control system connected to said interface, said control system having therein means for determining an antenna pattern and directing signals to said spatial light modulator;

means for focusing light from said spatial light modulator to form said antenna pattern;

a semiconductor antenna substrate, light from said means for focusing selectively directed to said antenna substrate whereby said antenna pattern is created upon said substrate to produce said antenna;

a feed circuit for said antenna substrate, said feed circuit placed upon said substrate and connected to said antenna;

a reflector means for controlling the directivity of said antenna; and a transceiver means connected to said feed circuit for processing signals to and/or from said antenna.

2. A reconfigurable antenna system as defined in claim 1 wherein said means for inputting light is a laser.

3. A reconfigurable antenna system as defined in claim 1 wherein said spatial light modulator is a digital micromirror device having a plurality of mirrors for directing the collimated light to said antenna substrate.

4. A reconfigurable antenna system as defined in claim 1 wherein said means for controlling the directivity of said antenna is a Fabry-Perot plate or a photonic band gap crystal.

5. A reconfigurable antenna system as defined in claim 1 wherein said antenna is planar.

6. A reconfigurable antenna system as defined in claim 5 wherein said antenna pattern is selected from the group consisting of a log periodic, a bow-tie, and a phased array antenna.

7. A reconfigurable antenna system as defined in claim 1 wherein said antenna is essentially nonexistant when not in use and thus minimizes RF reflections.

8. A reconfigurable antenna system as defined in claim 1 wherein different antenna patterns may be selected in a period of about 20 microseconds or less.

9. A reconfigurable antenna system as defined in claim 1 wherein a plurality of feed circuits are positioned on said substrate and are connected to the appropriate antenna pattern.

10. A process for creating a reconfigurable antenna, said process consisting of the steps of:

selecting an antenna pattern within a control system;

inputting said antenna pattern to a spatial light modulator through an electronic interface from said control system;

focusing light from said spatial light modulator onto a semiconductor substrate;

forming said antenna pattern on said semiconductor substrate to form an antenna;

connecting said antenna to a feed line;

controlling the directivity of said antenna; and processing output and/or input signals from said antenna.

11. A process for creating a reconfigurable antenna as defined in claim 10 wherein said inputting antenna pattern comes from a laser.

12. A process for creating a reconfigurable antenna as defined in claim 10 wherein illuminating a digital micro-mirror device having a plurality of mirrors for directing the collimated light image to said antenna substrate.

13. A process for creating a reconfigurable antenna as defined in claim 10 wherein said antenna is planar.

14. A process for creating a reconfigurable antenna as defined in claim 10 wherein said planar antenna pattern is selected from the group consisting of a log periodic, a bow-tie, and a phased array antenna.

15. A process for creating a reconfigurable antenna as defined in claim 10 wherein said antenna is essentially non-existent when not in use and thus minimizes RF reflections.

16. A process for creating a reconfigurable antenna as defined in claim 10 wherein different antenna patterns may be selected in a period of about 20 microseconds or less.

* * * * *